United States Patent [19]

Hasegawa

[11] Patent Number: 4,995,834

[45] Date of Patent: Feb. 26, 1991

[54] NOISE FILTER CONNECTOR

[75] Inventor: Izumi Hasegawa, Kawasaki, Japan

[73] Assignee: AMP Incorporated, Harrisburg, Pa.

[21] Appl. No.: 450,694

[22] Filed: Dec. 14, 1989

[30] Foreign Application Priority Data

Oct. 31, 1989 [JP] Japan ..... 1-127460[U]

[51] Int. Cl.[5] ..... H01R 13/66

[52] U.S. Cl. ..... 439/620; 333/182

[58] Field of Search ..... 439/608, 620; 333/182, 333/183

[56] References Cited

U.S. PATENT DOCUMENTS

| | | | |
|---|---|---|---|
| Re. 29,258 | 6/1977 | Fritz | 333/182 |
| 4,659,163 | 4/1987 | Althouse et al. | 439/608 |
| 4,784,618 | 11/1988 | Sakamoto et al. | 333/182 X |

*Primary Examiner*—Eugene F. Desmond

[57] ABSTRACT

A filter electrical connector comprises a dielectric housing (12), a metal shield case (13) covering the outside of the housing (12), aligned holes (21, 24) in rear walls (18, 19) of the housing (12) and the case (13), capacitors (14) secured in the holes (24) of wall (19) of case (13) and disposed in larger sections (22) of holes (21) in wall (18) of housing (12) without engaging the walls thereof, and electrical contacts (15) having contact sections (**15*a*) extending through the capacitors (14) and extending through smaller sections (23) of the holes (21) without engaging the walls thereof and into housing (12). Post sections (15*b*) of the contacts (15) extend exteriorly from the rear wall (19) of case (13) and extend through apertures (26) of an inductor (16**).

5 Claims, 4 Drawing Sheets

NOISE FILTER CONNECTOR

FIELD OF THE INVENTION

This invention relates to a noise filter connector or an electrical connector including noise filters.

BACKGROUND OF THE INVENTION

Conventional filter connectors of this type, for example, filter connectors for automobile applications to reject high frequency noise are constructed as shown in FIG. 8. The filter connector 1 comprises an insulation housing 2, an electrically-conductive shield case 3 covering the insulation housing 2, cylindrical capacitors 4 extending through the shield case 3 and soldered thereto, and electrically-conductive post or tab contacts 5 extending through the housing 2 and the capacitors 4 and soldered thereto. One end of each contact 5 is bent. The housing 2, the shield case 3 and the capacitors 4 are made of plastic, electrically-conductive metal and ceramic dielectric material, respectively. Also, the capacitors 4 include metal film electrodes.

The filter connector 1 is mounted on a printed circuit board 6 in such a manner that the contacts are inserted into through holes formed in circuit patterns on the circuit board 6. The filter connector 1 is mated with a complementary connector.

However, as understood from the above description, the contacts 5 of the conventional filter connector 1 are connected to the capacitors 4 in the metal shield case 3 and in engagement with the plastic housing 2. It is known that the materials of the housing 2 and the shield case 3 differ in thermal expansion coefficient. Additionally, one side surface of the housing 2 to retain contacts 5 is continuous. If the filter connector 1 having such housing 2 and shield case 3 is used under a certain environment encountering wide temperature changes, such difference in thermal expansion coefficient will cause displacement between both fixed points and, in turn, stress which will bend the contacts 5. A part of the stress affects the capacitors 4, thereby causing cracks in them which reduces capacitance or damaging the capacitors 4.

Also, when the housing 2 is mated with or unmated from a matable complementary connector to insert or extract contact sections of the contacts 5 with respect to contact sections of the complementary connector, bending force known as "kojiri" is caused at the contact sections and transmitted to the capacitors, thereby causing the aforementioned damage to the capacitors.

One conventional means to avoid such problems is to reduce the number of contacts in a filter connector which decreases the entire physical dimension of such connector, thereby limiting the total magnitude of stress due to different coefficients of thermal expansion within a tolerable range. This requires a plurality of housings each having a relatively small number of contacts if one needs a filter connector having a large number of contacts. Such housings are accommodated in a common shield case. However, such a filter connector suffers from reduced contact installation, density, limits freedom of contact arrangement, and makes connector assembly more complicated and expensive.

It is, therefore, an object of this invention to overcome the aforementioned problems and to provide a filter connector free from stress due to different coefficients of thermal expansion even if it is used under wider temperature changing conditions.

It is still another object of the present invention to provide a filter connector capable of avoiding such troubles in capacitors due to "kojiri".

SUMMARY OF THE INVENTION

In order to achieve the above object, the connector according to the present invention is directed to an electrical connector including noise filters comprising a housing, a shield case covering the housing, a plurality of capacitors in holes extending through the wall of the shield case, and contacts extending through the center holes of the capacitors and extending through the wall of the housing opposite to the wall of the shield case.

The filter connector according to the present invention is characterized in that the contacts extending through the holes in the wall of the housing without each contact engaging the inner wall of each of the holes.

In the preferred embodiment, the walls of the shield case and the housing are in engagement with each other or adjacent to each other. Portions of the capacitors extending inwardly from the inner wall surface of the shield case are freely received in larger diameter holes in the housing formed continuously and in alignment with the holes in the housing.

The contacts fixedly engaging the capacitors mounted on the shield case extend through the wall of the housing by loosely extending through the holes therein. When the connector is used under wide temperature changing conditions, any bending force in the contacts caused by different coefficients of thermal expansion between the housing and the shield case does not cause any adverse effect to the housing, and in turn, stress or damage to the capacitors.

Also, the shield case and the housing of the connector are preferably adjacent to each other for compact connector design. In this case, the above construction of loosely inserting the contacts in the holes in the housing as well as portions of the capacitors extending inwardly from the shield case in the larger diameter holes in continuous and aligned relationship with the holes in the wall of the housing is effective to avoid any adverse effect between the contacts and the housing and also stress or damage to the capacitors.

To achieve the other object, the connector according to the present invention has a reinforcement member mounted on the wall of the shield case for retaining both end portions of the capacitors between the wall of the shield case and the reinforcement member through which the capacitors extend.

Also, the capacitors are secured in the wall of the shield case near one end of each capacitor and also in the reinforcement member mounted on the wall of the shield case near the other end of each capacitor. The capacitors are well protected from "kojiri" at the contact sections when the connector housing is mated with or unmated from the matable complementary connector housing.

BRIEF DESCRIPTION OF THE DRAWINGS

The filter connector according to the present invention will be described in detail hereunder by way of example to preferred embodiments with reference to the accompanying drawings.

DETAILED DESCRIPTION OF THE INVENTION

Figure 1:
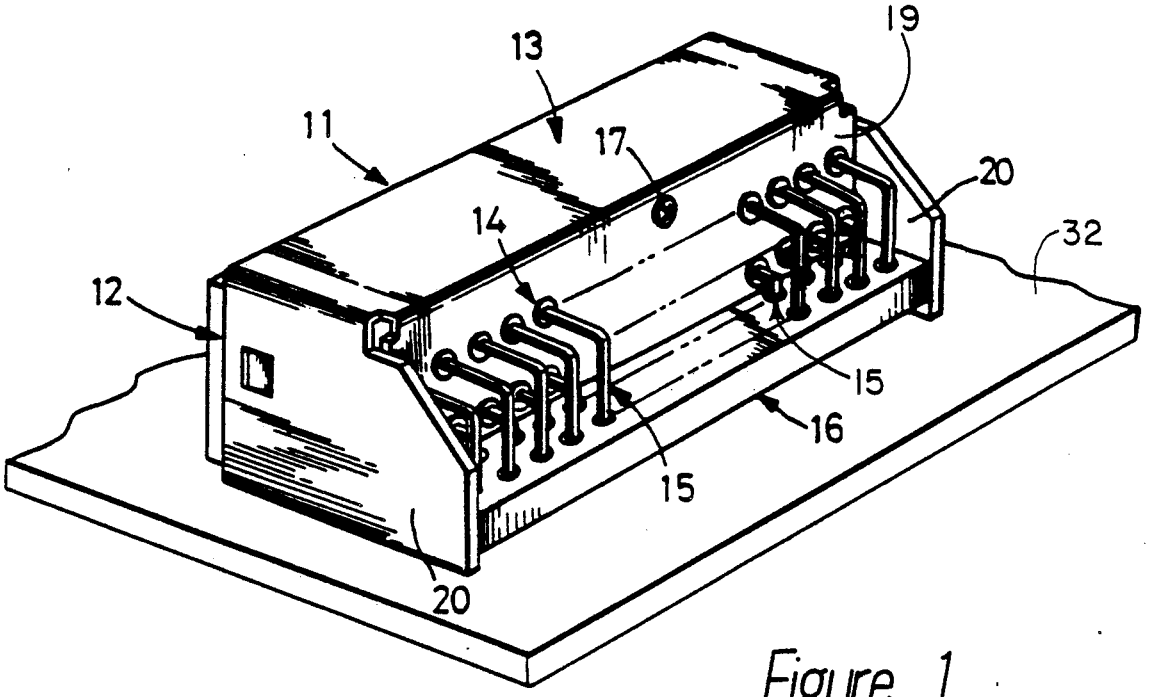
FIG. 1 is a perspective view of the entire connector of one embodiment of the present invention.
Figure 2:
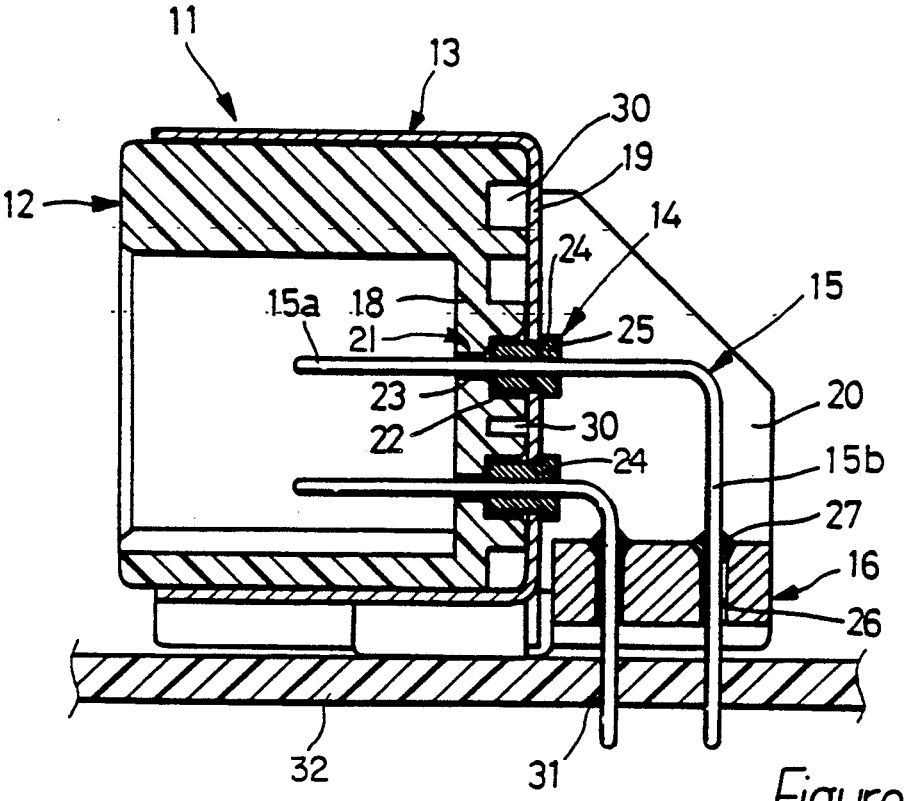
FIG. 2 is a cross-sectional view of the connector in FIG. 1 perpendicular to the length of the connector.

In FIGS. 1 and 2, a filter connector 11 includes an insulation housing 12, an electrically-conductive shield case 13, cylindrical capacitors 14, electrically-conductive post or tab contacts 15, and an inductor block 16. The housing 12 is made of a suitable plastic material. The shield case 13 is made of electrically-conductive metal. The capacitors 14 are made of ceramic dielectric material and metal film electrodes. The contacts 15 are made of electrically-conductive metal. The inductor block 16 is made of ferrite material.

The housing 12 and the shield case 13 are open at their front ends and are mated with both rear walls 18, 19 engaging each other and secured together by a screw 17 from the shield case 13 into the housing 12. The shield case 13 has extended side wall sections 20. The rear wall 18 of the housing 12 has holes 21 in two vertical rows at a constant pitch in the length direction. Each hole 21 comprises an outer larger diameter section 22 and an inner smaller diameter section 23 formed continuously and concentrically in a stepped configuration.

Holes 24 are formed in the rear wall 19 of the shield case 13 in correspondence to the larger diameter sections 22 in the housing 12. The capacitors 14 are inserted in the holes 24 and mounted thereon by soldering in the condition that flanges 25 of the capacitors 14 contact the outer surface of the rear wall 19 of the shield case 13. Also, portions of the capacitors 14 extending inwardly from the rear wall 19 are positioned in the larger diameter sections 22 in the housing 12 in such a manner that the outer surface of the capacitors 14 do not engage the inner circumferential wall of the larger diameter sections 22 in the housing 12. The inner ends of the capacitors 14 may lightly engage the inner ends of the respective larger diameter sections 22 but it is preferable to be slightly isolated therefrom. Outer sections 22 and inner sections 23 can be round, square or rectangular depending on the configurations of the capacitors 14 and contacts 15.

Figure 3:
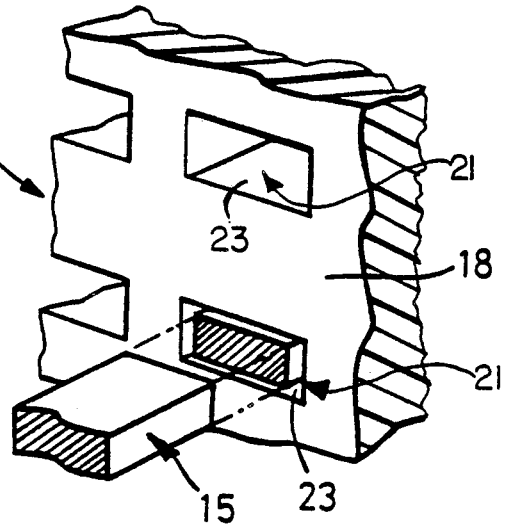
FIG. 3 is a part perspective view illustrating the relationship between the through holes in the housing and the contacts.
Figure 8:
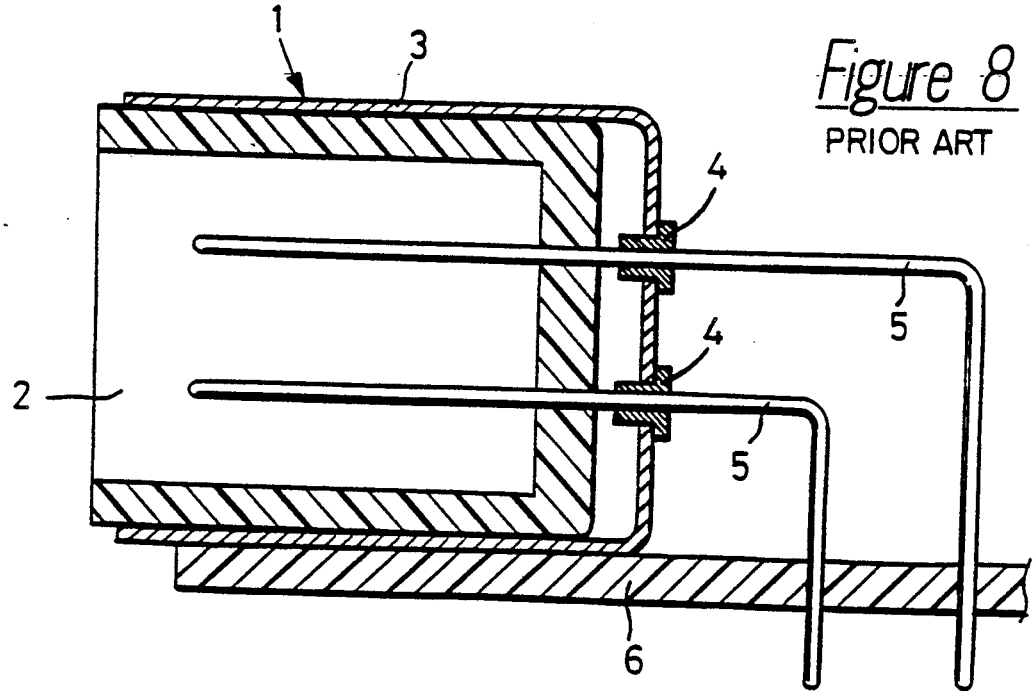
Figure 8 PRIOR ART
FIG. 8 is a cross-sectional view, similar to FIG. 2, of a conventional connector.

The contacts 15 extend into the housing 12 via contact sections **15*a* and extend outside of the shield case 13 via post sections 15*b* through the center openings of the respective capacitors 14 and soldered thereto. The contacts 15 pass through the smaller diameter sections 23 in such a manner that the outer surfaces of the contacts 15 do not engage the inner surfaces of the smaller diameter sections 23 (see FIG. 3). Also, the contacts 15 are bent downwardly at desired locations outside of the shield case 13 so that they extend through holes 26 in the inductor block 16 positioned between both extended side wall sections 20. The post sections 15*b* of the contacts 15 are secured in the holes 26 in the inductor block 16 using acrylic adhesive material 27 or the like. Grooves 30 are located in the rear wall 18 of the housing 12**.

The filter connector 11 of the above construction is mounted on the printed circuit board 32. Electrical connections are made by inserting the post sections **15*b* of the contacts 15 into holes 31 of the circuit board 32 at appropriate circuit patterns. A housing of a matable complementary electrical connector (not shown in the drawings) is mated with the filter connector 11. In this way, the contact sections 15*a* of the contacts 15** are electrically connected to corresponding contact sections of receptacle type contacts secured in the complementary connector.

It is to be noted that the rear walls 18, 19 of the housing 12 and the shield case 13 of the present connector are preferably engaged as shown in FIG. 2 for miniaturization and increasing mechanical strength of the connector 11; however, they may be slightly separated. In the present connector, the inductor block 16 is made of ferrite and in conjunction with the shield case 13 and the capacitors 14, they act as filter devices. The inductor block 16 also acts as an alignment and securing member for the post sections **15*b* of the contacts 15. It is, therefore, preferable to use the inductor block 16. It is appreciated, however, that the inductor block 16** is not essential to the present device and may be a single or a plurality of separate members.

Figure 4:
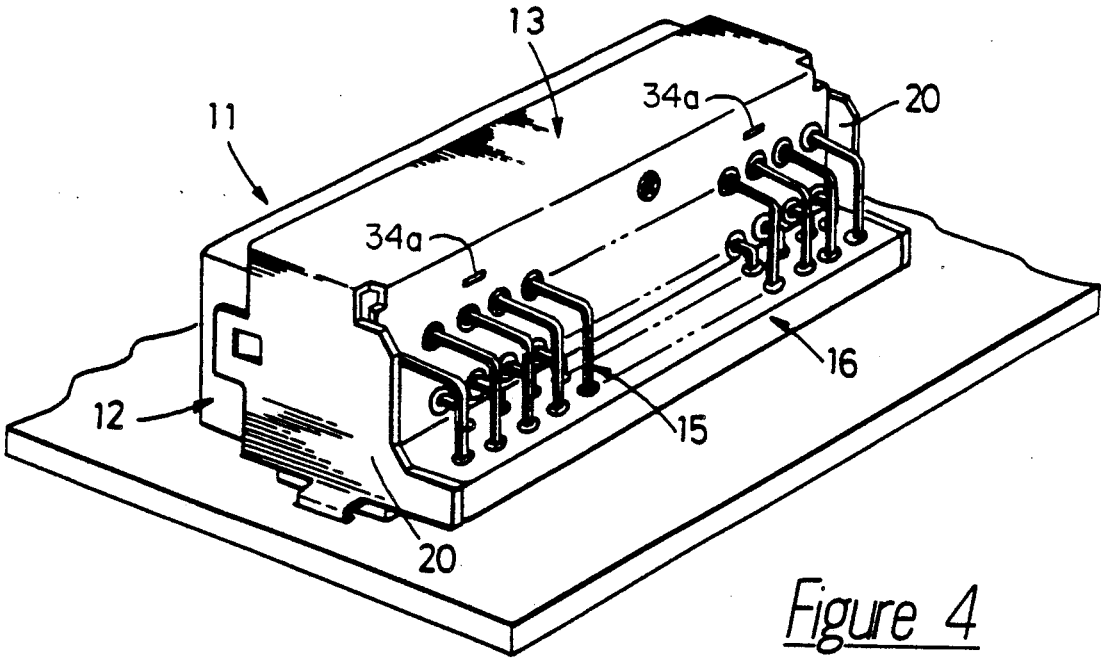
FIG. 4 is a perspective view of another embodiment of the connector according to the present invention.
Figure 5:
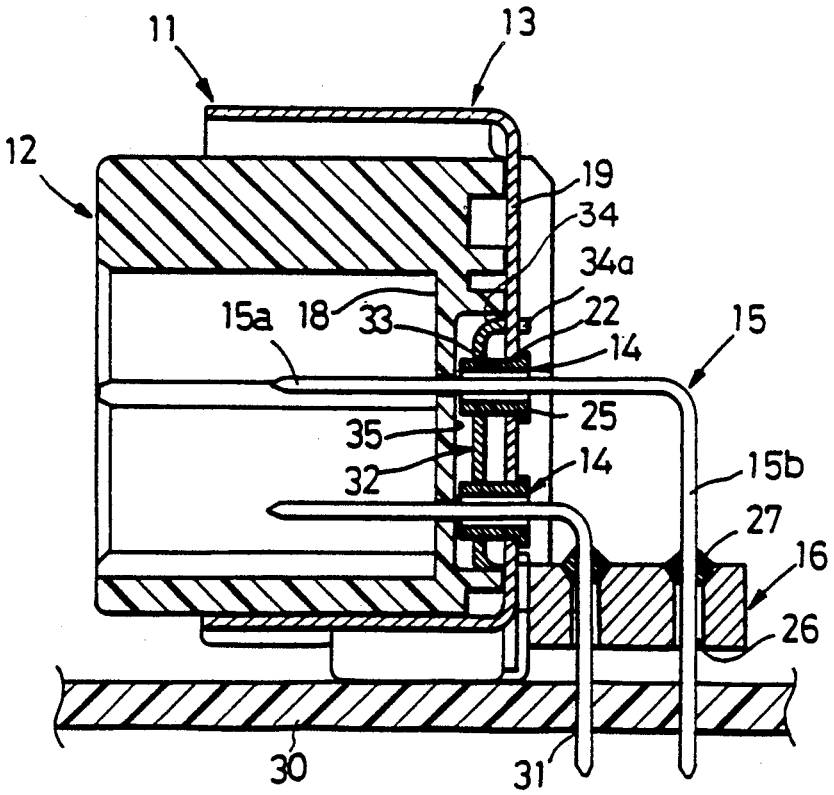
FIG. 5 is a cross-sectional view of the connector in FIG. 4 in a transverse direction.

Illustrated in FIGS. 4 and 5 is another embodiment of the present connector. In this embodiment, the connector 11 is essentially the same as the first embodiment in basic construction except for the provision of a reinforcement member 32. Therefore, similar reference numerals are used to represent like members or positions.

The reinforcement member 32 is made of a metal plate and has holes 33 of a given pitch at the central area thereof and securing members **34*a* on inwardly-bent spacers 34. The reinforcement member 32 is positioned between a back wall 19 of the shield case 13 and a concave section 35 in a back wall 18 of the housing 12. The securing members 34*a* extend through slots in the back wall 19 of the shield case 13 and soldered to be firmly mounted on the back wall 19. Front end sections of the capacitors 14 extend through the holes 33 of the reinforcement member 32 and are retained in the holes at the circumferential surfaces of the capacitors 14**.

Figure 6:
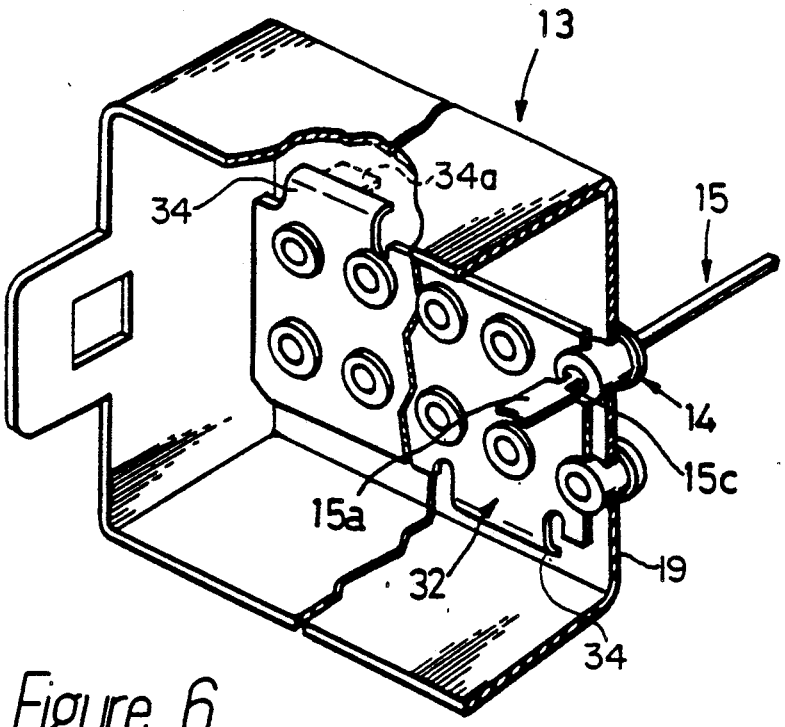
FIG. 6 is a part perspective view of the connector in FIG. 4 seen from the inside thereof.
Figure 7:
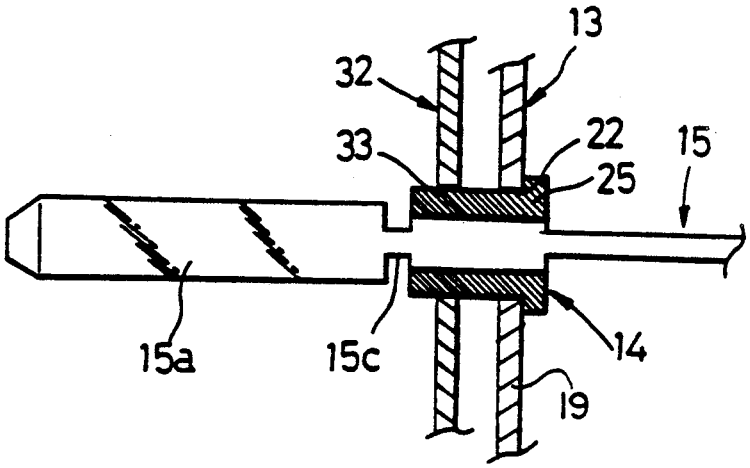
FIG. 7 is a part cross-sectional view illustrating the relationship between the shield case, the reinforcement member, the capacitors and the contacts.

As shown in FIGS. 6 and 7, the contacts 15 are provided with neck sections **15*c* between the front end surface of the capacitors 14 and the contact tab sections 15*a*. The neck sections 15 act to cancel any "kojiri" to the tab sections 15*a* when inserted in or extracted from receptacle contact sections of a complementary connector. As a result, the neck sections 15*c* as well as retention of the front ends of the capacitors 14 in the holes 33 helps to minimize transmission of "kojiri" which is a major cause of breaking the capacitors 14**.

The present connector is constructed and operates as discussed above. When it is used under wide temperature changing conditions to cause bending of the contacts due to different coefficients of thermal expansion between the housing and the shield case, the contacts cause no adverse effect such as stress to the housing, and, in turn, to the capacitors. This avoids possible damage to the capacitors including reduced capacitance due to cracks, etc.

Also, "kojiri" that may be caused at the contact sections during mating and unmating of the housing with the complementary connector housing is effectively eliminated from the capacitors because of firm retention of the capacitors by the reinforcement member, thereby avoiding the aforementioned trouble due to such "kojiri".

Also, the aforementioned physical relationship between the contacts and the housing and between the capacitors and the housing simplifies the connector assembly.

I claim:

1. An electrical connector, comprising:

a dielectric housing having a dielectric rear wall through which holes extend, each said hole opening into a recess in said rear wall;

a metal shield case covering the outside of said housing;

a metal rear wall extending along the dielectric rear wall and having openings in alignment with the respective holes in said dielectric rear wall;

capacitors secured in said openings in said metal rear wall in electrical connection therewith with a section of each capacitor being disposed in said recess without engaging the walls of said recess; and electrical contacts having contact sections extending through the capacitors in electrical connection therewith and extending through the respective holes in the dielectric rear wall without engaging the walls of said holes and into said housing.

2. An electrical connector as claimed in claim 1, wherein said rear walls are in engagement or closely adjacent to each other.

3. An electrical connector as claimed in claim 1, wherein said contacts have post sections extending exteriorly of the metal rear wall and through apertures in an inductor member.

4. An electrical connector as claimed in claim 1, wherein a reinforcement member is mounted on said metal rear wall and having further openings in alignment with the respective openings of said metal rear wall with ends of said capacitors disposed in said further openings.

5. An electrical connector as claimed in claim 4, wherein the contact sections adjacent said ends of said capacitors have neck sections.

* * * * *